US010544920B2

(12) United States Patent
Jordan et al.

(10) Patent No.: US 10,544,920 B2
(45) Date of Patent: Jan. 28, 2020

(54) REPEATABLE LOUVER ACCESSORY FOR LUMINAIRES

(71) Applicant: SIGNIFY HOLDING B.V., Eindhoven (NL)

(72) Inventors: Timothy Jordan, Andover, MA (US); Ray Debruin, Merrimack, NH (US); Brian Roberge, Franklin, MA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/569,628

(22) PCT Filed: Apr. 22, 2016

(86) PCT No.: PCT/EP2016/058965

§ 371 (c)(1),
(2) Date: Oct. 26, 2017

(87) PCT Pub. No.: WO2016/177584

PCT Pub. Date: Nov. 10, 2016

(65) Prior Publication Data

US 2018/0356071 A1 Dec. 13, 2018

Related U.S. Application Data

(60) Provisional application No. 62/156,657, filed on May 4, 2015.

(51) Int. Cl.

| | |
|---|---|
| ***F21V 11/00*** | (2015.01) |
| ***F21V 17/00*** | (2006.01) |
| ***F21V 17/10*** | (2006.01) |
| *F21Y 115/10* | (2016.01) |
| *F21W 131/107* | (2006.01) |

(52) U.S. Cl.

CPC ..... *F21V 11/00* (2013.01); *F21V 17/002* (2013.01); *F21V 17/005* (2013.01); *F21V 17/10* (2013.01); *F21W 2131/107* (2013.01); *F21Y 2115/10* (2016.08)

(58) Field of Classification Search

CPC .... F21V 17/002; F21V 19/003; F21V 17/005; F21V 17/10; F21V 17/12

USPC ..... 362/219, 236

See application file for complete search history.

(56) References Cited

U.S. PATENT DOCUMENTS

| | | | | |
|---|---|---|---|---|
| 2,597,739 | A | 5/1952 | Lacy et al. | |
| 9,395,052 | B1 * | 7/2016 | Shew | F21K 9/27 |

(Continued)

FOREIGN PATENT DOCUMENTS

| | | | |
|---|---|---|---|
| BE | 516235 | A | 12/1952 |
| CN | 201270336 | Y | 7/2009 |

(Continued)

*Primary Examiner* — Karabi Guharay

(74) *Attorney, Agent, or Firm* — Daniel J. Piotrowski

(57) ABSTRACT

A luminaire accessory is provided. A first louver part (16) has a plurality of cells (18) arranged in a predetermined pattern and has at least one set of alignment features. A second louver part (16'), unassembled is identical to the first louver part (16). When assembled, the second louver part (16') is rotated 180° with respect to the first louver part (16) and the alignment features (20) are configured to mate to a second set of alignment features (20') disposed on the second louver part (16').

15 Claims, 4 Drawing Sheets

(56) References Cited

U.S. PATENT DOCUMENTS

| | | | | |
|---|---|---|---|---|
| 2006/0215405 | A1* | 9/2006 | Jung | F21K 9/00<br>362/249.01 |
| 2010/0118532 | A1* | 5/2010 | Liang | F21S 2/005<br>362/235 |
| 2013/0301264 | A1 | 11/2013 | Van Gompel et al. | |

FOREIGN PATENT DOCUMENTS

| | | | |
|---|---|---|---|
| CN | 201356322 | Y | 12/2009 |
| CN | 101806403 | A | 8/2010 |
| CN | 202205942 | U | 4/2012 |
| CN | 2302817 | U | 11/2013 |
| WO | 2013065146 | A1 | 5/2013 |
| WO | 2014132186 | A1 | 9/2014 |

* cited by examiner

REPEATABLE LOUVER ACCESSORY FOR LUMINAIRES

CROSS-REFERENCE TO PRIOR APPLICATIONS

This application is the U.S. National Phase application under 35 U.S.C. § 371 of International Application No. PCT/EP2016/058965, filed on Apr. 22, 2016 which claims the benefit of U.S. Provisional Patent Application No. 62/156,657, filed on May 4, 2015. These applications are hereby incorporated by reference herein.

FIELD OF THE INVENTION

The present invention is directed generally to a repeatable louver accessory for use in preventing light glare in luminaires.

BACKGROUND

Architectural floodlights are used to light the exterior or interior of a building. These floodlights, also called luminaires, are used to highlight a building's attractive architectural features and to create a warm and welcoming ambience. They are also used to draw attention to retail displays, or other attractions, such as a public monuments, casinos, and skyscrapers.

Because luminaires often use high-powered LEDs, it is often necessary to block the light at certain viewing angles. For example, when lighting a building, a louver may be used to shield passing pedestrians or drivers from the powerful light sources. To prevent glare at certain viewing angles, a louver is often used to direct the light in a particular direction. Louvers use channels, slots, or other means to permit the light at one angle, or set of angles, but block the light at other angles.

Tooling a large louver from a single tool is often not feasible because large injection tools are difficult to manufacture. Additionally, tooling a large louver is expensive, produces long tooling lead times and doubles the cost of the tool. However, tooling separate louver designs may result in misalignment with the luminaire optics, and undesirably obstruct the LEDs, reducing light output.

Accordingly, there is a need in the art for a single louver design that does not require a large tool to manufacture, and that properly aligns with the luminaire optics when installed.

SUMMARY OF THE INVENTION

The present disclosure is directed to an inventive louver design that may be tooled with a single tool and that aligns with luminaire optics when installed. Various embodiments and implementations herein are directed to a louver part that may be combined with a duplicate, rotated louver part, to form a full louver. The louver part engages with alignment features of the duplicate, rotated louver part. For example, in some embodiments, the louver part includes at least one tab and one slot, formed along one side edge, arranged to permit the louver part to mate with the duplicate rotated louver part.

Generally, in one aspect, a luminaire accessory includes a first louver part having a plurality of cells arranged in a predetermined pattern and having at least one set of alignment features; a second louver part, unassembled being identical to the first louver part; and wherein when assembled, the second louver part is rotated 180° with respect to the first louver part and the alignment features are configured to mate to a second set of alignment features disposed on the second louver part.

In some embodiments, the alignment features extend from a first side edge being bisected by a central axis to form a first portion and second portion, the alignment features comprising: a tab, having a predetermined dimension, extending from the first portion and spaced apart from the central axis by a first distance; and a slot being disposed in the second portion and spaced apart from the central axis by the first distance, wherein said slot is adapted to mate with a second tab having said predetermined dimension, from the second set of alignment features.

In some embodiments, the luminaire accessory includes a third tab, having a second predetermined dimension, extending from the first portion and spaced apart from the central axis by a second distance and a third slot being disposed in the second portion and spaced apart from the central axis by the second distance, wherein the third slot is adapted to mate with a fourth tab, having the second predetermined dimension, from the second set of alignment features.

In some embodiments, the first predetermined dimension and the second predetermined dimension are the same.

In some embodiments, the luminaire accessory includes a third tab, having a second predetermined dimension, extending from the second portion and spaced apart from the central axis by a second distance; and a third slot being disposed in the first portion and spaced apart from the central axis by the second distance, wherein the third slot is adapted to mate with a fourth tab, having the second predetermined dimension, from the second set of alignment features.

In some embodiments, the predetermined pattern of cells is, in a first position, configured to align with a first half of a set of optics disposed in the luminaire.

In some embodiments, the predetermined pattern of cells is, in a second position, configured to align with a second half of the set of optics disposed in the luminaire, wherein the second position is rotated 180° with respect to the first position.

In some embodiments, the luminaire accessory includes a flange, extending from a second side edge, and adapted to mount to the luminaire.

In some embodiments, the flange is positioned to extend from a second axis that longitudinally bisects the second side edge.

In some embodiments, the flange is positioned to dispose the louver part into a recess, defined by an accessory bezel, when mounted to the luminaire.

In some embodiments, the flange further extends from a third side edge.

In some embodiments, the louver part is formed from an injection-molded plastic.

In some embodiments, each cell is a hole formed through the louver part.

In some embodiments, the luminaire accessory further includes a shield fitted around and extending beyond the louver part.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the concepts disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF THE EMBODIMENTS

The present disclosure describes various embodiments of apparatus, systems, and devices for forming a louver from a single, repeatable louver design. More generally, Applicants have recognized and appreciated that it would be beneficial to create larger louvers, from a single, smaller, combinable louver design. A particular goal of utilization of embodiments of the present disclosure is to be able to manufacture a large louver that properly aligns with the luminaire optics, without requiring a large tool.

In view of the foregoing, various embodiments and implementations are directed to a louver part that may be combined with a duplicate, rotated louver part, to form a full louver. The louver part may include at least one tab and one slot, formed along one side edge, that are arranged to permit the louver part to mate with the duplicate rotated louver part. The tab and slot may be located on separate sides of a central axis that bisects the side edge into equal halves. The tab and slot are both spaced the same distance from the central axis so that the tab is positioned to insert into the slot of the rotated, duplicate louver part, and the slot is positioned to receive the tab of the rotated, duplicate louver part. The rotation of the louver part 16' by 180° allows manufacturing of only one part which can be used twice.

Figure 1:
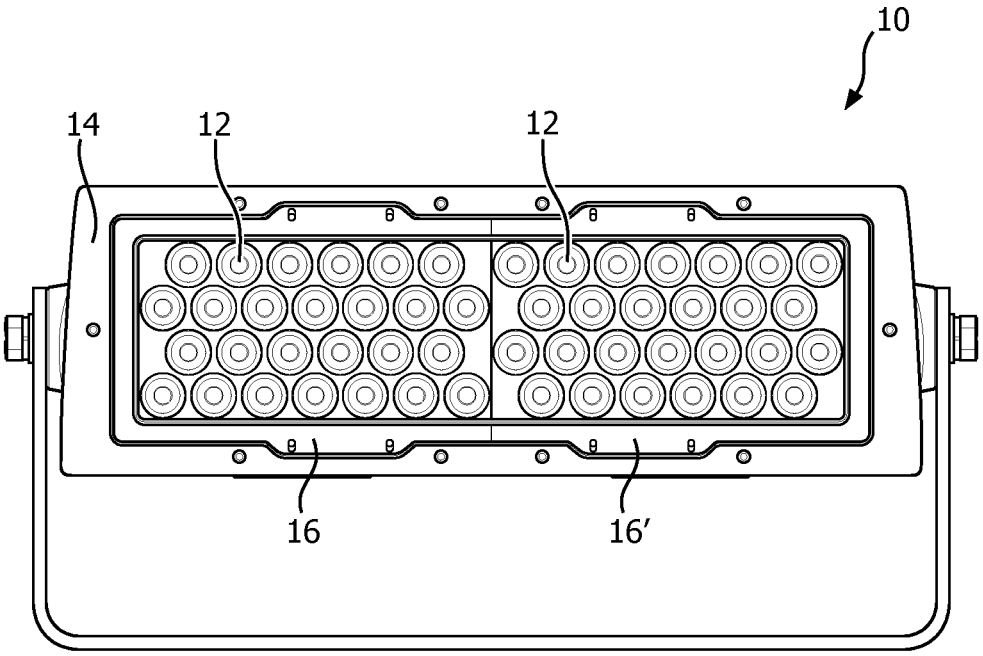
FIG. 1 is a schematic representation of luminaire with a louver part in accordance with an embodiment of the invention.

Referring to FIG. 1, there is shown an embodiment of a luminaire 10, having a plurality of luminaire optics 12, and a raised accessory bezel 14. Mounted to luminaire 10 is louver part 16 and louver part 16', a duplicate of louver part 16. When mated together and installed, louver part 16' is rotated 180° with respect to louver part 16. Thus, louver part 16 is configured to mate to a duplicate of itself, rotated 180°.

Figure 2:
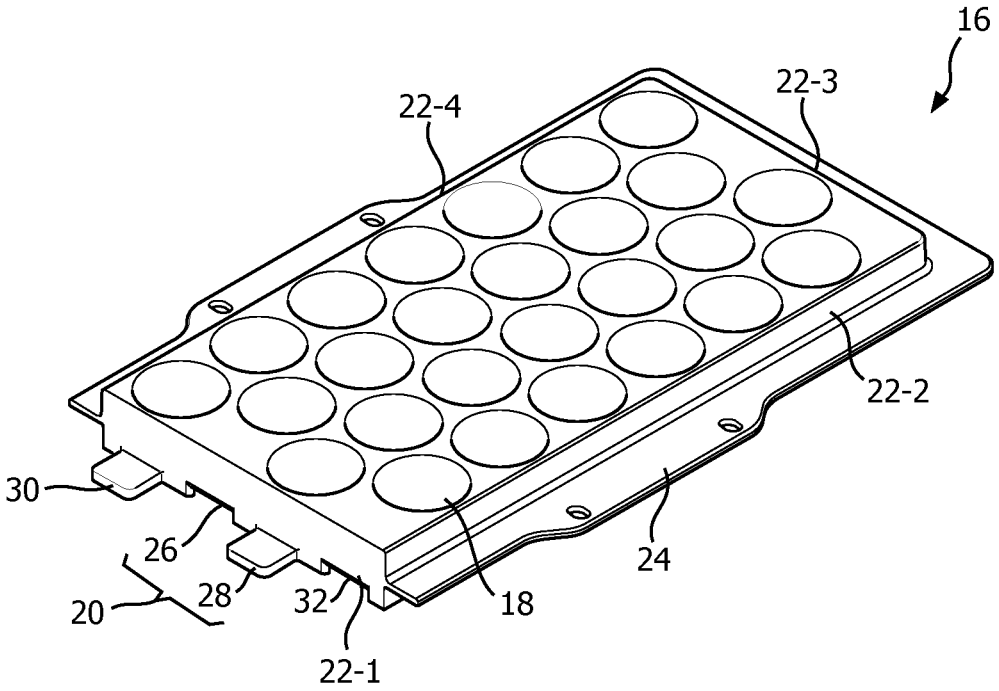
FIG. 2 is schematic representation of a louver part in accordance with an embodiment of the invention.

In the embodiment illustrated in FIG. 2, louver part 16 may include: a pattern of cells 18, alignment features 20 extending from one side edge 22-1 of louver 16, and a flange 24 extending from the remaining sides edges 22-2, 22-3, and 22-4 of louver part 16. Alignment features 20 may be comprised of a pair of tabs and slots formed in side edge 22-1. In an exemplary embodiment, louver part 16 is formed from injection-molded plastic, although other known methods of forming a louver may be used.

Alignment features 20, as will be discussed in detail below, ensure that louver part 16 is properly aligned with louver part 16' during installation. Alignment features 20 further allow for all of the louver cells 18 to be directly aligned with the luminaire optics 12. This eliminates light cut-off in the direction of the light source and maximizes light output. Alignment features 20 also provide a visual cue to the installer of each louver part's 16, 16' correct orientation. In the embodiment shown, louver part 16 includes two tab/slot pairs: tab 26 and slot 28 forming one pair and tab 30 and slot 32 forming the other. Although, two pairs are shown, louver part 16 may have, in alternate embodiments, one tab/slot pair, or any other number of mating alignments as may be formed in louver part 16.

Cells 18 may consist of holes formed through louver part 16 or, in alternate embodiments, as channels or slots. One of ordinary skill will appreciate that cells 18 may be formed in any way sufficient to permit light to pass through louver part 16 at a desired angles or set of angles. The cell 18 pattern may be arranged to align with luminaire optics 12. Because luminaires often comprise two LED boards, one rotated 180° with respect to the other, installing rotated louver part 16' over the rotated LED board aligns the cells 18' with the LEDs of the rotated LED board. In this way, cells 18 align with the first half of luminaire optics 12 and cells 18' align with the second, rotated half of luminaire optics 12. One of ordinary skill in the art will recognize that any number of cell 18 patterns may be used. In addition, the cell 18 spacing, cell 18 shape, and cell 18 depth may vary in alternate embodiments. Indeed, the characteristics of each cell may vary within a single embodiment to achieve the desired light cut-off angles.

Flange 24 provides a surface for mounting louver part 16 to a luminaire 10. To this end, flange 24 may be adapted to receive mounting hardware, such as a screw and washer, for attaching louver part 16 to luminaire 10. In the embodiment shown, flange 24 may extend from each of the three side edges 22-2, 22-3, 22-4, that do not possess alignment features 20. In alternate embodiments, flange 24 may only extend from one or two side edges 22. In addition, flange 24 may extend the length of each side edge 22, or, alternately, from only a portion of each side edge 22.

Figure 3A:
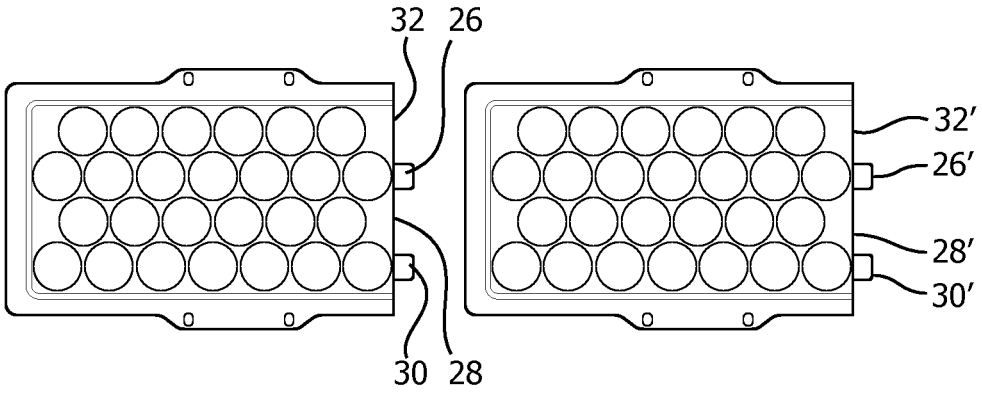
FIGS. 3A, 3B, and 3C are schematic representations of louver parts in accordance with an embodiment of the invention.
Figure 3B:
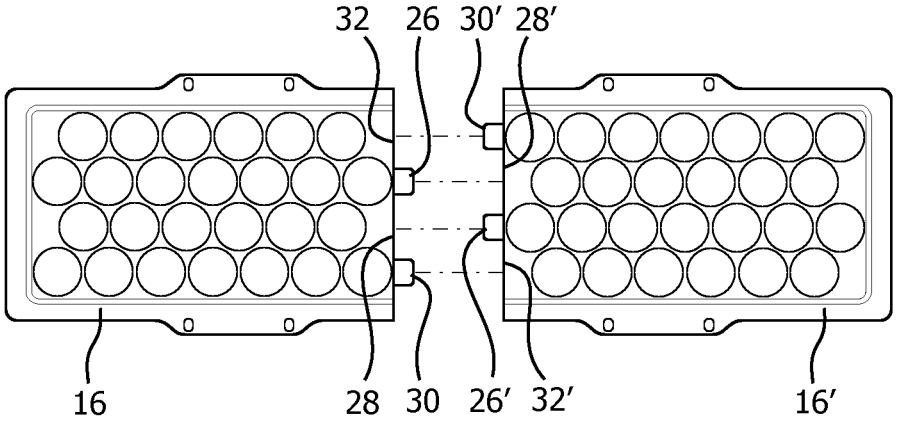
Figure 3C:
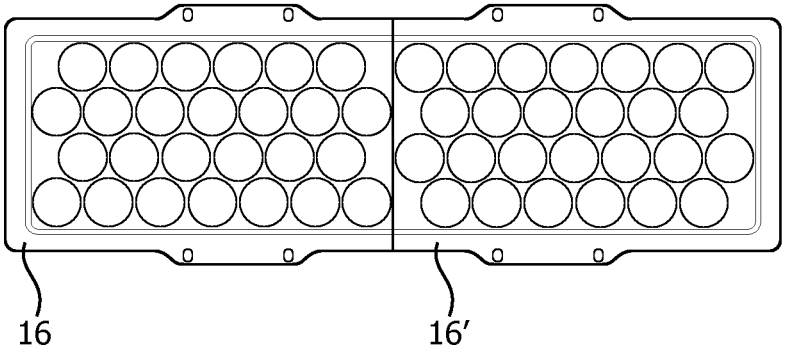

Referring to FIG. 3A, both louver parts 16, 16' are shown together in the same orientation. In FIG. 3B, louver part 16' is rotated 180°, such that the alignment features 20 of each louver part are aligned. This view shows that when louver part 16' is rotated 180°, tab 26 is aligned with slot 28', tab 30 is aligned with slot 32', tab 26' is aligned with slot 28, and tab 30' is aligned with slot 32. This alignment is allowed by the spacing of each tab and slot from central axis, as described below. FIG. 3C shows louver part 16 and louver part 16' fully mated together.

Figure 4A:
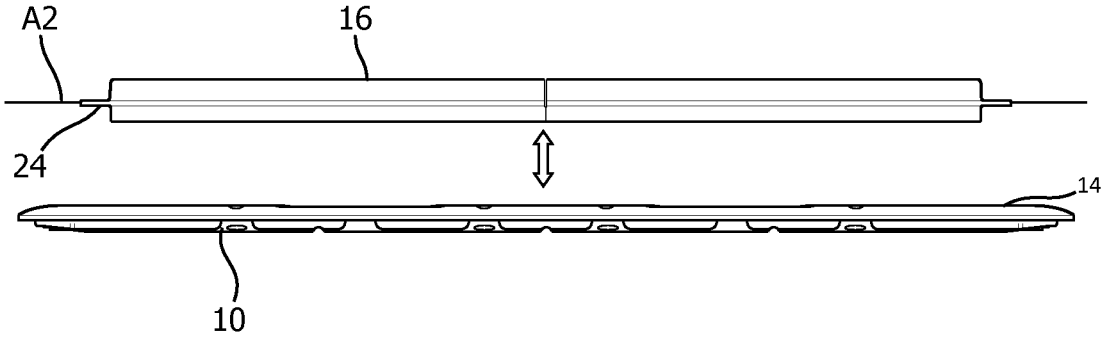
FIGS. 4A and 4B are schematic representations of a louver part with a flange, and a luminaire in accordance with an embodiment of the invention.
Figure 4B:
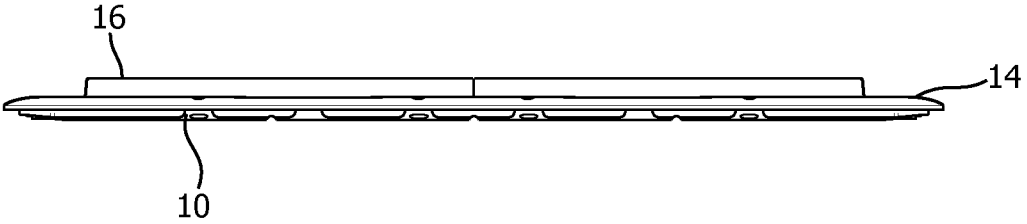

Referring to FIG. 4A, there is shown a side view of louver part 16 and a side view of a portion of the front surface of luminaire 10, including bezel 14. In the embodiment shown, flange 24 may extend along a central, longitudinal axis A2 of the side edge 22, to allow louver part 16 to be recessed into accessory bezel 14 when installed. FIG. 4B shows louver part 16 mounted to bezel 14 of luminaire 10. Because flange 24 extends along central longitudinal axis A2 of side edge 22, the bottom half of louver 16 is recessed in accessory bezel 14 when louver part 16 is installed. Recessing louver part 16 into accessory bezel 14 lowers the profile of luminaire 10, reduces the amount of light blocked by louver part 16, and eliminates light leakage through flange 24. As will be appreciated by a person of ordinary skill, flange 24 may be positioned above or below axis A2, to vary the amount that louver part 16 is recessed in accessory bezel 14.

Figure 5:
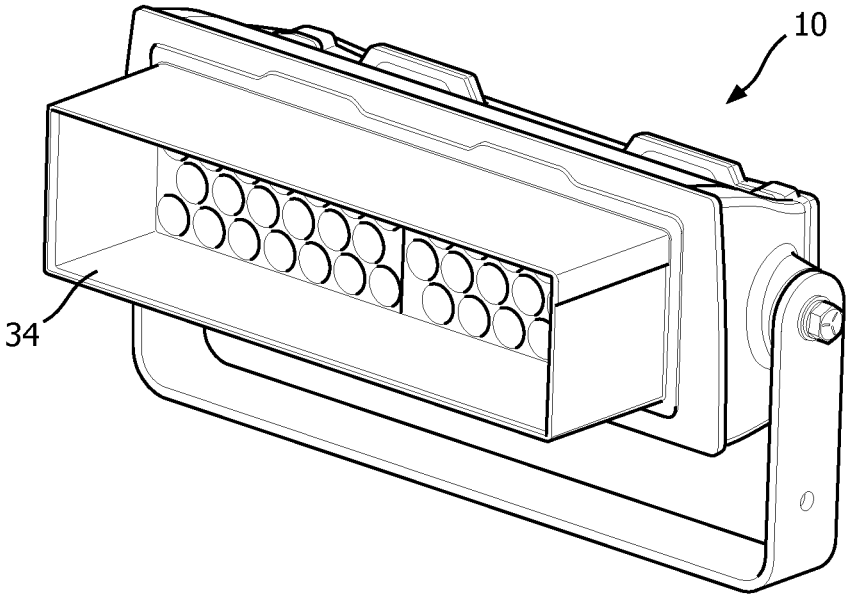
FIG. 5 is a schematic representation of a luminaire with a louver and a shield in accordance with an embodiment of the invention.

FIG. 5. shows a luminaire 10 with an additional shield 34 installed to manage glare. Shield 34 may be fitted over louver part 10. As will be appreciated by a person of ordinary skill, different shield sizes, angles, and shapes may be used to achieve different degrees of glare management.

Figure 6:
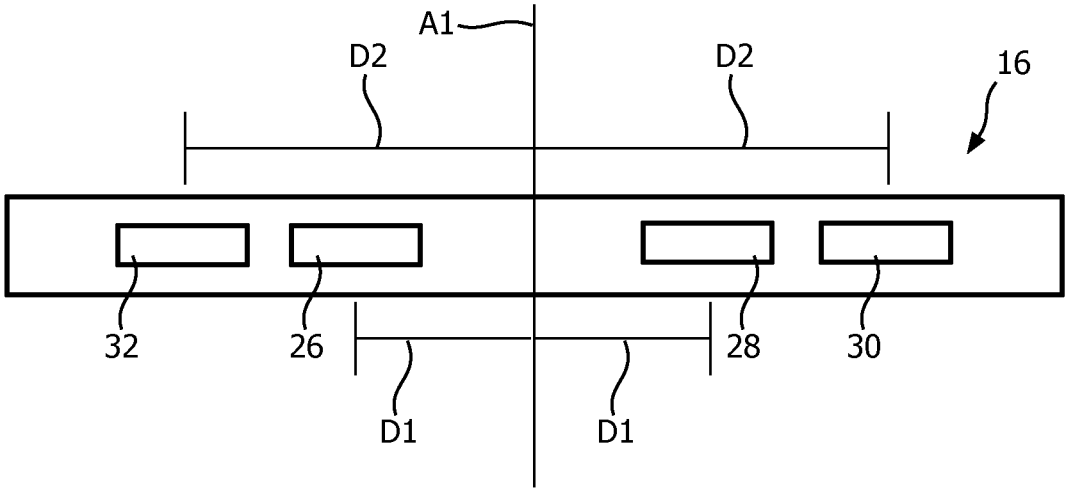
FIG. 6 is a side view schematic of louver parts in accordance with an embodiment of the invention.

Referring to FIG. 6, there is seen a side view of an embodiment of louver part 16. In the embodiment depicted, louver part 16 is bisected by central axis A1. Tab 26 and slot 28 are each separated from central axis A1 by the same distance D1. Similarly, tab 30 and slot 32 are each separated from central axis by the same distance D2. This spacing allows louver part 16 to mate with duplicate louver part 16' (not shown), which also has tab 26' and slot 28' spaced from central axis A1' by distance D1, and tab 30' and slot 32' spaced from central axis A1' by distance D2. Because louver part 16' is rotated 180° when mated, spacing D1 ensures that tab 26 will align with slot 28' and slot 28 will align with tab 26', and spacing D2 ensures that tab 30 will align with slot 32' and slot 32 will align with tab 30'. Although the tabs and slots are shown to alternate, one of ordinary skill in the art will recognize that two tabs or two slots may be positioned adjacent to one another. It is only important that each tab/pair are positioned on opposite sides of central axis A1. For example, the position of tab 30 and slot 32 may be swapped, so long as they remain on opposite sides of central axis A1.

Furthermore, to fit together, each slot must be sized to receive the tab that is spaced apart from the central axis by the same distance. For example, slot 28 must be sized to receive tab 26. In an exemplary embodiment, each slot may be sized to be only slightly larger than the tab (of duplicate louver part 16') it receives, so that there is minimal play in the connection of louver part 16 with louver part 16'. In alternate embodiments, each tab may be formed to grasp each slot to firmly mate louver part 16 with louver part 16'. This may be accomplished by shaping each tab to have a hooked ending that fits into a groove formed within a slot. Alternately, each tab may be configured to expand within a slot, once inserted. One of ordinary skill in the art will appreciate that the tabs and slots may be formed in any number of ways to allow a tab to fit within, or grasp the interior of, a respective slot. Additionally, one of ordinary skill will appreciate that each pair of tabs and slots may differ from another pair of tabs and slots in size and shape. For example, slot 28 and tab 26 may be one size and shape, while slot 32 and tab 30 may be a different size and shape.

While several inventive embodiments have been described and illustrated herein, those of ordinary skill in the art will readily envision a variety of other systems and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The invention claimed is:

1. A luminaire accessory, comprising:

a first louver part having a plurality of cells arranged in a predetermined pattern and having a set of alignment features on one end; and a second louver part, unassembled being identical to the first louver part;

wherein when assembled, the second louver part must be rotated 180° with respect to the first louver part so that the alignment features mate to a second set of alignment features disposed on the second louver part, wherein the predetermined pattern of cells is, in a first position, configured to align with a first half of a set of optics disposed in the luminaire.

2. The luminaire accessory of claim 1, wherein the alignment features extend from a first side edge of louver being bisected by a central axis to form a first portion and second portion, the alignment features comprising:

a tab, having a predetermined dimension, extending from the first portion and spaced apart from the central axis by a first distance; and a slot being disposed in the second portion and spaced apart from the central axis by the first distance, wherein said slot is adapted to mate with a second tab having said predetermined dimension, from the second set of alignment features.

3. The luminaire accessory of claim 2, further comprising:

a third tab, having a second predetermined dimension, extending from the first portion and spaced apart from the central axis by a second distance; and a third slot being disposed in the second portion and spaced apart from the central axis by the second distance, wherein the third slot is adapted to mate with a fourth tab, having the second predetermined dimension, from the second set of alignment features.

4. The luminaire accessory of claim 3, wherein the first predetermined dimension and the second predetermined dimension are the same.

5. The luminaire accessory of claim 2, further comprising:

a third tab, having a second predetermined dimension, extending from the second portion and spaced apart from the central axis by a second distance; and a third slot being disposed in the first portion and spaced apart from the central axis by the second distance, wherein the third slot is adapted to mate with a fourth tab, having the second predetermined dimension, from the second set of alignment features.

6. The luminaire accessory of claim 5, wherein the first predetermined dimension and the second predetermined dimension are the same.

7. The luminaire accessory of claim 1, wherein the predetermined pattern of cells is, in a second position, configured to align with a second half of the set of optics disposed in the luminaire, wherein the second position is rotated 180° with respect to the first position.

8. The luminaire accessory of claim 1, further comprising:

a flange, extending from a second side edge, and adapted to mount to the luminaire.

9. The luminaire accessory of claim 8, wherein the flange is positioned to extend from a second axis that longitudinally bisects the second side edge.

10. The luminaire accessory of claim 8, wherein the flange is positioned to dispose the louver part into a recess, defined by an accessory bezel, when mounted to the luminaire.

11. The luminaire accessory of claim 8, wherein the flange further extends from a third side edge and a fourth side edge.

12. The luminaire accessory of claim 1, wherein the louver part is formed from an injection-molded plastic.

13. The luminaire accessory of claim 1, wherein each cell is a hole formed through the louver part.

14. The luminaire accessory of claim 1, further comprising a shield fitted around and extending beyond the louver part.

15. The luminaire accessory of claim 1, wherein each cell includes a channel or slot formed through the louver part to permit the light at one angle, or set of angles, but block the light at another angle.

* * * * *